US008034215B2

(12) United States Patent
Knobloch et al.

(10) Patent No.: US 8,034,215 B2
(45) Date of Patent: Oct. 11, 2011

(54) PATTERNED FIBROUS STRUCTURES

(75) Inventors: Thorsten Knobloch, Loveland, OH (US); Luis Bernardo De La Rosa, Mason, OH (US); Gregg Thomas Weaver, Liberty Township, OH (US); Jennifer Hope Dolan, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 915 days.

(21) Appl. No.: 11/068,125

(22) Filed: Feb. 28, 2005

(65) Prior Publication Data

US 2006/0113049 A1 Jun. 1, 2006

Related U.S. Application Data

(60) Provisional application No. 60/631,344, filed on Nov. 29, 2004.

(51) Int. Cl.
*B31F 1/07* (2006.01)
*D21H 27/30* (2006.01)

(52) U.S. Cl. ..... 162/117; 162/109; 162/123; 428/156; 428/172

(58) Field of Classification Search ..... 162/109, 162/111–113, 117, 123–133; 428/156, 172
See application file for complete search history.

(56) References Cited

U.S. PATENT DOCUMENTS

| | | | | |
|---|---|---|---|---|
| 5,328,565 | A * | 7/1994 | Rasch et al. | 162/113 |
| 5,431,786 | A * | 7/1995 | Rasch et al. | 162/348 |
| D362,967 | S | 10/1995 | Rothwell et al. | |
| D382,162 | S | 8/1997 | Ertolacci et al. | |
| D382,713 | S | 8/1997 | Giesler, Sr. | |
| D384,210 | S | 9/1997 | Du Grosriez | |
| D386,620 | S | 11/1997 | Giesler | |
| 5,702,571 | A * | 12/1997 | Kamps et al. | 162/117 |
| D392,108 | S | 3/1998 | Diggins et al. | |
| D395,955 | S | 7/1998 | Du Grosriez | |
| 5,834,099 | A * | 11/1998 | Steinhardt et al. | 428/198 |
| 5,874,156 | A * | 2/1999 | Schulz | 428/156 |
| 5,902,669 | A * | 5/1999 | Steinhardt et al. | 428/198 |
| D416,393 | S | 11/1999 | Enderby et al. | |
| D419,307 | S | 1/2000 | Boyce | |
| D419,780 | S | 2/2000 | Funk et al. | |
| D422,150 | S | 4/2000 | Enderby | |
| D423,232 | S | 4/2000 | Reid | |
| D426,709 | S | 6/2000 | Latchoo et al. | |
| D426,959 | S | 6/2000 | Jahner et al. | |
| D426,960 | S | 6/2000 | Jahner et al. | |

(Continued)

FOREIGN PATENT DOCUMENTS

EP 1096069 A2 * 5/2001

(Continued)

OTHER PUBLICATIONS

U.S. Appl. No. 29/217,495, filed Nov. 19, 2004, Knobloch et al.

(Continued)

*Primary Examiner* — Jose A Fortuna
(74) *Attorney, Agent, or Firm* — C. Brant Cook

(57) ABSTRACT

Patterned fibrous structures, more particularly to fibrous structures that comprise a pattern that conveys to a user a characteristic of the fibrous structure and/or single- or multi-ply sanitary tissue product comprising such a patterned fibrous structure and methods for making same are provided.

7 Claims, 1 Drawing Sheet

U.S. PATENT DOCUMENTS

| | | | | |
|---|---|---|---|---|
| D428,264 | S | 7/2000 | Boyce | |
| D428,265 | S | 7/2000 | Jahner et al. | |
| D428,267 | S | 7/2000 | Romano, III et al. | |
| D428,708 | S | 8/2000 | Jahner et al. | |
| D428,709 | S | 8/2000 | Jahner et al. | |
| D429,893 | S | 8/2000 | Jahner et al. | |
| D430,406 | S | 9/2000 | Ingalls | |
| D430,407 | S | 9/2000 | Ingalls | |
| D431,371 | S | 10/2000 | Ingalls et al. | |
| D431,372 | S | 10/2000 | Ingalls et al. | |
| 6,129,972 | A * | 10/2000 | McNeil et al. | 428/154 |
| D433,239 | S | 11/2000 | Jahner et al. | |
| D436,740 | S | 1/2001 | Jahner et al. | |
| D438,017 | S | 2/2001 | Reid | |
| D438,711 | S | 3/2001 | Graff et al. | |
| D440,773 | S | 4/2001 | Rogers et al. | |
| D441,167 | S | 4/2001 | Graff et al. | |
| D441,540 | S | 5/2001 | Enderby et al. | |
| D441,541 | S | 5/2001 | Greenfield et al. | |
| D442,786 | S | 5/2001 | Enderby et al. | |
| 6,235,373 | B1 * | 5/2001 | Graff | 428/172 |
| D447,875 | S | 9/2001 | Graff et al. | |
| D448,574 | S | 10/2001 | Graff et al. | |
| D448,575 | S | 10/2001 | Graff et al. | |
| D449,452 | S | 10/2001 | Graff et al. | |
| D449,453 | S | 10/2001 | Duritsch et al. | |
| D450,934 | S | 11/2001 | Duritsch et al. | |
| D451,682 | S | 12/2001 | Jahner et al. | |
| D453,421 | S | 2/2002 | Greenfield et al. | |
| 6,395,133 | B1 * | 5/2002 | McNeil | 162/132 |
| 6,413,614 | B1 * | 7/2002 | Giesler et al. | 428/156 |
| D461,317 | S | 8/2002 | Jahner et al. | |
| D463,137 | S | 9/2002 | Monroe et al. | |
| D465,093 | S | 11/2002 | Jahner et al. | |
| D465,338 | S | 11/2002 | Jahner et al. | |
| 6,524,683 | B1 * | 2/2003 | Roussel et al. | 428/172 |
| 6,554,959 | B2 * | 4/2003 | Von Paleske et al. | 162/109 |
| 6,602,577 | B1 * | 8/2003 | Ostendorf et al. | 428/156 |
| 6,649,024 | B2 * | 11/2003 | Oriarian et al. | 162/109 |
| 6,733,866 | B2 * | 5/2004 | Muller | 428/172 |
| D494,766 | S | 8/2004 | Boerschinger et al. | |
| D496,797 | S | 10/2004 | Boerschinger et al. | |
| 6,805,766 | B1 * | 10/2004 | Roussel et al. | 156/209 |
| D508,613 | S * | 8/2005 | Knobloch et al. | D5/57 |
| D521,250 | S * | 5/2006 | Knobloch et al. | D5/53 |
| 7,083,845 | B2 * | 8/2006 | Graff | 428/166 |
| 7,320,743 | B2 * | 1/2008 | Freidbauer et al. | 162/117 |
| D564,238 | S * | 3/2008 | Knobloch et al. | D5/57 |
| 7,384,506 | B2 * | 6/2008 | Underhill et al. | 162/117 |
| 7,687,140 | B2 * | 3/2010 | Manifold et al. | 428/326 |
| 7,704,601 | B2 * | 4/2010 | Manifold et al. | 428/326 |
| 2001/0032712 | A1 * | 10/2001 | Friedbauer et al. | 162/109 |
| 2003/0021954 | A1 * | 1/2003 | Graff | 428/156 |
| 2003/0041989 | A1 * | 3/2003 | Oriarian et al. | 162/184 |
| 2003/0118782 | A1 * | 6/2003 | Graff | 428/172 |
| 2003/0192662 | A1 * | 10/2003 | Heath et al. | 162/111 |
| 2005/0034828 | A1 * | 2/2005 | Graff et al. | 162/123 |
| 2005/0067089 | A1 * | 3/2005 | Graff et al. | 156/209 |
| 2005/0069574 | A1 * | 3/2005 | Loughran et al. | 424/443 |
| 2005/0098281 | A1 * | 5/2005 | Schulz et al. | 162/117 |
| 2006/0062972 | A1 * | 3/2006 | Lefebvre Du Grosriez et al. | 428/172 |
| 2006/0088697 | A1 * | 4/2006 | Manifold et al. | 428/174 |
| 2006/0108082 | A1 * | 5/2006 | Bogdanski et al. | 162/143 |
| 2006/0113049 | A1 * | 6/2006 | Knobloch et al. | 162/117 |
| 2006/0278356 | A1 * | 12/2006 | Boatman et al. | 162/117 |
| 2007/0056704 | A1 * | 3/2007 | Wilke, II | 162/117 |
| 2007/0062658 | A1 * | 3/2007 | Wiwi et al. | 162/117 |
| 2007/0122595 | A1 * | 5/2007 | Basler et al. | 428/174 |
| 2009/0117331 | A1 * | 5/2009 | Fung et al. | 428/154 |
| 2009/0218056 | A1 * | 9/2009 | Manifold et al. | 162/109 |
| 2009/0218057 | A1 * | 9/2009 | Manifold et al. | 162/109 |
| 2009/0218058 | A1 * | 9/2009 | Manifold et al. | 162/109 |
| 2009/0218063 | A1 * | 9/2009 | Manifold et al. | 162/231 |
| 2009/0220731 | A1 * | 9/2009 | Manifold et al. | 428/113 |
| 2009/0220741 | A1 * | 9/2009 | Manifold et al. | 428/141 |
| 2009/0220769 | A1 * | 9/2009 | Manifold et al. | 428/326 |
| 2009/0311478 | A1 * | 12/2009 | Ehlerding et al. | 428/152 |
| 2010/0139876 | A1 * | 6/2010 | Manifold et al. | 162/123 |
| 2010/0239825 | A1 * | 9/2010 | Sheehan et al. | 428/172 |

FOREIGN PATENT DOCUMENTS

| | | | |
|---|---|---|---|
| WO | WO 0031342 | A1 * | 6/2000 |
| WO | WO 0228630 | A2 * | 4/2002 |
| WO | WO 2006036194 | A1 * | 4/2006 |

OTHER PUBLICATIONS

U.S. Appl. No. 29/213,823, filed Sep. 23, 2004, Knobloch et al.
Bounty® paper towel product—2003.
Royale Premier paper towel product—2003.
ScotTowels Jumbo paper towel product—2003.
Ja! paper towel product—2003.
Tesco Ultra paper towel product—2003.
Cascades Ultra paper towel product—2003.

* cited by examiner

PATTERNED FIBROUS STRUCTURES

CROSS REFERENCE TO RELATED APPLICATIONS

This application claims the benefit of U.S. Provisional Application Ser. No. 60/631,344 filed on Nov. 29, 2004.

FIELD OF THE INVENTION

The present invention relates to patterned fibrous structures, more particularly to fibrous structures that comprise a pattern that conveys to a user a characteristic of the fibrous structure and/or single- or multi-ply sanitary tissue product comprising such a patterned fibrous structure and methods for making same.

BACKGROUND OF THE INVENTION

Some consumers of fibrous structures and/or sanitary tissue products comprising fibrous structures, such as toilet tissue, paper towels and/or facial tissue, desire for their fibrous structures and/or sanitary tissue products to convey characteristics of the fibrous structures and/or sanitary tissue products by a visually recognizable pattern. For example, some consumers desire to have both visually recognizable softness and strength characteristics conveyed to them via their fibrous structures and/or sanitary tissue products.

Conventionally, such softness and strength characteristics have been perceived as being diametrically opposed. For example, the softer a fibrous structure was, the less strong it should be and vice versa. Accordingly, fibrous structure and/or sanitary tissue product manufacturers tried to convey either softness characteristics or strength characteristics, but not both in the same fibrous structure and/or sanitary tissue product.

Accordingly, a long felt need existed to identify a fibrous structure and/or sanitary tissue product that conveyed both visually recognizable softness and strength characteristics.

SUMMARY OF THE INVENTION

The present invention fulfills the need described above by providing a patterned fibrous structure that conveys to a user both visually recognizable softness and strength characteristics.

In one example of the present invention, a fibrous structure comprising a visually recognizable softness region and a visually recognizable strength region, is provided.

In another example of the present invention, an embossed fibrous structure comprising a visually recognizable softness region and a visually recognizable strength region, wherein the visually recognizable strength region comprises a plurality of embossments and the visually recognizable softness region comprises less embossments that the visually recognizable strength region, is provided.

In yet another example of the present invention, an embossed fibrous structure comprising a visually recognizable softness region and a visually recognizable strength region, wherein the visually recognizable softness region is void of embossments and the visually recognizable strength region comprises an embossment, is provided.

In even another example of the present invention, an embossed fibrous structure comprising a visually recognizable softness region and a visually recognizable strength region, wherein the fibrous structure essentially consists of a plurality of embossments, wherein the plurality of embossments exhibit a substantially similar shape, is provided.

In still another example, a single- or multi-ply sanitary tissue product comprising a fibrous structure according to the present invention, is provided.

In still yet another example, a method for making a fibrous structure according to the present invention, is provided.

Accordingly, the present invention provides a fibrous structure and/or sanitary tissue product comprising a visually recognizable softness region and a visually recognizable strength region and methods for making same.

DETAILED DESCRIPTION OF THE INVENTION

Definitions

Figure 1:
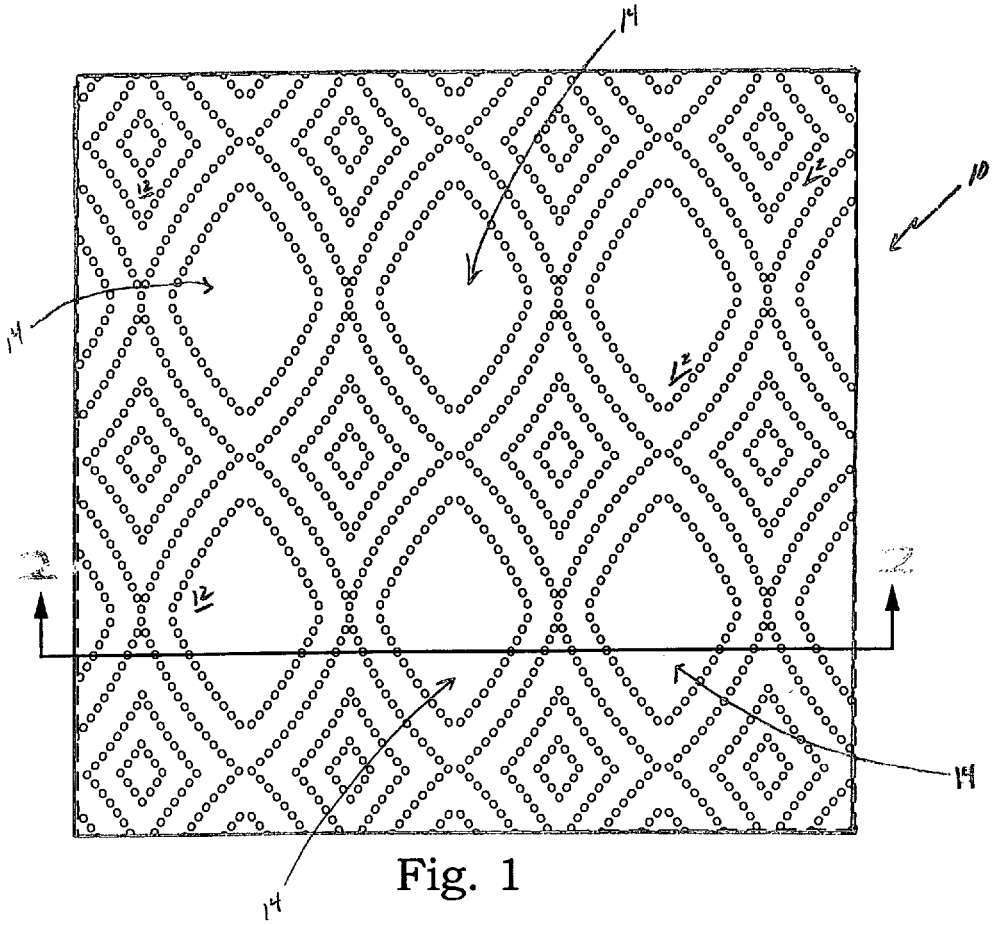
FIG. 1 is a plan view of one example of a fibrous structure in accordance with the present invention.

"Fibrous structure" and/or "Web" as used herein means a substrate formed from non-woven fibers. The fibrous structure of the present invention may be made by any suitable process, such as wet-laid, air-laid, spunbond processes. The fibrous structure may be in the form of one or more plies suitable for incorporation into a sanitary tissue product and/or may be in the form of non-woven garments, such as surgical garments including surgical shoe covers, and/or non-woven sanitary tissue products such as surgical towels and wipes.

An embryonic fibrous web can be typically prepared from an aqueous dispersion of fibers, though dispersions in liquids other than water can be used. Such a liquid dispersion of fibers is oftentimes called a fibrous slurry. The fibers can be dispersed in the carrier liquid to have a consistency of from about 0.1% to about 0.3%. It is believed that the present invention can also be applicable to moist forming operations where the fibers are dispersed in a carrier liquid to have a consistency less than about 50%, more preferably less than about 10%.

Alternatively, an embryonic fibrous web can be prepared using air laid technology wherein a composition of fibers, (not typically dispersed in a liquid) are deposited onto a surface, such as a forming member, such that an embryonic web is formed.

The fibrous structures of the present invention may have physical properties, such as dry tensile strength, wet tensile strength, caliper, basis weight, density, opacity, wet burst, decay rate, softness, bulk, lint and sidedness suitable to consumers for fibrous structures used in sanitary tissue products and/or known by those skilled in the art to be suitable for fibrous structures used in sanitary tissue products.

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, and bagasse can be used in this invention. Synthetic fibers such as rayon and other polymeric fibers such as polypropylene, polyethylene, polyester, polyolefin, polyethylene terephthalate and nylon and various hydroxyl polymers, can be used. The polymeric fibers can be produced by spunbond processes, meltblown processes, and other suitable methods known in the art.

The fibers may be short or long (e.g., NSK fibers). Non-limiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, Magnolia, Bagasse, Flax, Hemp, Kenaf and mixtures thereof.

"Fibrous furnish" as used herein means a composition of fibers. In one example, the fibrous furnish may comprise fibers and a liquid, such as water.

"Sanitary tissue product" as used herein means a single- or multi-ply wiping implement for post-urinary and post-bowel movement cleaning (toilet tissue), for otorhinolaryngological discharges (facial tissue), and multi-functional absorbent and cleaning uses (absorbent towels).

The sanitary tissue products of the present invention may have physical properties, such as dry tensile strength, wet tensile strength, caliper, basis weight, density, opacity, wet burst, decay rate, softness, bulk, lint and sidedness suitable to consumers for use as sanitary tissue products and/or known by those skilled in the art to be suitable for use as sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or sanitary tissue product comprising the fibrous structure.

"Dry Tensile Strength" (or simply "Tensile Strength" as used herein) of a fibrous structure of the present invention and/or a sanitary tissue product comprising such fibrous structure is measured as follows. One (1) inch by five (5) inch (2.5 cm×12.7 cm) strips of fibrous structure and/or sanitary tissue product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%+10%. The cross-head speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$ (20.3 $cm^2$). The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Softness" of a fibrous structure according to the present invention and/or a sanitary tissue product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

The fibrous structure and/or sanitary tissue product of the invention may be a single ply web or may be one ply or a multi-ply structure. A multi-ply fibrous structure may be comprised of multiple plies of a fibrous structure of the present invention or of a combination of a plies, at least one of which is a fibrous structure ply of the present invention.

"User" as used herein means a consumer and/or purchaser of a fibrous structure and/or sanitary tissue product, preferably a purchaser.

"Characteristic" as used herein means a quality or property inherent in a fibrous structure and/or sanitary tissue product. Aesthetics of a fibrous structure and/or sanitary tissue product are not a characteristic as defined herein. Nonlimiting examples of such characteristics include softness, absorbency, cleaning ability and/or strength.

"Visually recognizable" as used herein as it pertains to a characteristic of a fibrous structure and/or sanitary tissue product means that by visual inspection of the fibrous structure and/or sanitary tissue product and/or via touching of the fibrous structure and/or sanitary tissue product, the user perceives that fibrous structure and/or sanitary tissue product as having a characteristic.

"Embossment" as used herein means a deformation of the fibrous structure or portion of the fibrous structure in the Z-plane such that the surface of the fibrous structure comprises a protrusion or a depression. The embossment may be made by conventional embossing procedures known in the art or they may be made by forming the fibrous structure on a deflection member such as described in U.S. Pat. No. 4,637,859 and/or on an imprinting carrier fabric as described in U.S. Pat. Nos. 3,301,746, 3,821,068, 3,974,025, 3,573,164, 3,473,576, 4,239,065 and 4,528,239. Embossments according to the present invention may exhibit a dry structural height of at least about 100 μm and/or at least about 150 μm and/or at least about 200 μm and/or at least about 250 μm and/or at least about 300 μm and/or at least about 400 μm and/or at least about 500 μm and/or at least about 600 μm as measured by the Dry-Wet Structural Height Test Method.

Embossments according to the present invention may exhibit a ratio of greatest geometric dimension to minimum geometric dimension (often referred to as an aspect ratio) of less than about 50:1 and/or less than about 30:1 and/or less than about 15:1 and/or less than about 10:1 and/or less than about 5:1 and/or less than about 2:1 and/or about 1:1. The embossments may be dots and/or dashes. A plurality of embossments may combine to form a "macro" pattern on the fibrous structure surface that encompasses and/or covers less than the entire surface of the fibrous structure. In addition to the embossments, there may be other deformations (protrusions or depressions) that are less visible on the fibrous structure that encompass and/or cover almost the entire surface of the fibrous structure. Such other deformations form a "micro" pattern on the fibrous structure surface.

"Signature element" as used herein means a design that has a shape more complex than just a straight line, dot, dash or other simple shape. Nonlimiting examples of signature elements include flowers, hearts, and other user recognizable unitary designs. Signature elements may be signature bosses as described in U.S. Pat. No. 5,620,776 to Schulz.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure and/or Sanitary Tissue Product:

The present invention is applicable to fibrous structures in general, including but not limited to conventionally felt-pressed fibrous structures; pattern densified fibrous structures; through-air-dried fibrous structures, differential density fibrous structures, wet laid fibrous structures, air laid fibrous structures, conventional fibrous structures, meltblown fibrous structures, spunbond fibrous structures, rotary spun fibrous structures, high-bulk, uncompacted fibrous structures and mixtures thereof. The fibrous structures may be of a homogenous or multilayered construction; and the sanitary tissue products made therefrom may be of a single-ply or multi-ply construction.

The fibrous structures may be made with a fibrous furnish that produces a single layer embryonic fibrous web or a fibrous furnish that produces a multi-layer embryonic fibrous web.

The fibrous structure and/or sanitary tissue product comprises one or more plies of fibrous structure. The fibrous structure and/or sanitary tissue product may be in individual sheet form or may be in roll form. If in roll form, the fibrous structure and/or sanitary tissue product may comprise a core upon which the one or more plies of fibrous structure are convolutely wound.

The fibrous structure and/or sanitary tissue product and/or plies from which the fibrous structure and/or sanitary tissue product is derived may be foreshortened, such as via creping, or non-forshortened, such as not creping; creped from a cylindrical dryer with a creping doctor blade, removed from a cylindrical dryer without the use of a creping doctor blade, or made without a cylindrical dryer.

The fibrous structure and/or sanitary tissue products of the present invention are useful in paper, especially sanitary tissue sanitary tissue products including, but not limited to: conventionally felt-pressed tissue paper; through-air dried tissue paper; pattern densified tissue paper; and high-bulk, uncompacted tissue paper. The tissue paper may be of a homogenous or multilayered construction; and tissue sanitary tissue products in accordance with the present invention are of a multi-ply construction. The tissue paper preferably has a basis weight of between about 10 g/m$^2$ and about 120 g/m$^2$, and density of about 0.60 g/cc or less. Preferably, the basis weight will be below about 35 g/m$^2$; and the density will be about 0.30 g/cc or less. Most preferably, the density will be between about 0.04 g/cc and about 0.20 g/cc as measured by the Basis Weight Method described herein.

The fibrous structure and/or sanitary tissue product may be made with a fibrous furnish that produces a single layer embryonic fibrous web or a fibrous furnish that produces a multi-layer embryonic fibrous web.

The fibrous structure and/or sanitary tissue product may comprise an adhesive, such as a ply bond adhesive.

The fibrous structures of the present invention and/or sanitary tissue products comprising such fibrous structures may have a basis weight of between about 10 g/m$^2$ to about 120 g/m$^2$ and/or from about 14 g/m$^2$ to about 80 g/m$^2$ and/or from about 20 g/m$^2$ to about 60 g/m$^2$.

The fibrous structures of the present invention and/or sanitary tissue products comprising such fibrous structures may have a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structures of the present invention and/or sanitary tissue products comprising such fibrous structures may have a density of about 0.60 g/cc or less and/or about 0.30 g/cc or less and/or from about 0.04 g/cc to about 0.20 g/cc.

In one embodiment, the fibrous structure of the present invention is a pattern densified fibrous structure characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified fibrous structures are well known in the art as exemplified in U.S. Pat. Nos. 3,301,746, 3,974,025, 4,191,609 and 4,637,859.

In general, pattern densified fibrous structures are preferably prepared by depositing a papermaking furnish on a foraminous forming wire such as a Fourdrinier wire to form a wet fibrous structure and then juxtaposing the fibrous structure against a three-dimensional substrate comprising an array of supports. The fibrous structure is pressed against the three-dimensional substrate, thereby resulting in densified zones in the fibrous structure at the locations geographically corresponding to the points of contact between the array of supports and the wet fibrous structure. The remainder of the fibrous structure not compressed during this operation is referred to as the high-bulk field. This high-bulk field can be further dedensified by application of fluid pressure, such as with a vacuum type device or a blow-through dryer, or by mechanically pressing the fibrous structure against the array of supports of the three-dimensional substrate. The fibrous structure is dewatered, and optionally predried, in such a manner so as to substantially avoid compression of the high-bulk field. This is preferably accomplished by fluid pressure, such as with a vacuum type device or blow-through dryer, or alternately by mechanically pressing the fibrous structure against an array of supports of the three-dimensional substrate wherein the high-bulk field is not compressed. The operations of dewatering, optional predrying and formation of the densified zones may be integrated or partially integrated to reduce the total number of processing steps performed. Subsequent to formation of the densified zones, dewatering, and optional predrying, the fibrous structure is dried to completion, preferably still avoiding mechanical pressing.

In one example, a fibrous structure 10 according to the present invention, as shown in FIG. 1, comprises a surface 12 and a visually recognizable softness region 14 and a visually recognizable strength region 16. The visually recognizable strength region 16 may comprise one or more embossments 18. In one example, the visually recognizable strength region 16 comprises a plurality of embossments 18. The visually recognizable softness region 14 may comprise no embossments 18 and/or fewer embossments 18 than the visually recognizable strength region 16.

The fibrous structure 10 may comprise a plurality of visually recognizable softness regions 14 and/or a plurality of visually recognizable strength regions 16. Each individual visually recognizable softness region 14 may be visually similar to another individual visually recognizable softness region 14 or they may be visually different from one another. For example, one individual visually recognizable softness region 14 may essentially consists of no embossments 18 and another may consist of a plurality of embossments 18.

A visually recognizable softness region 14 may be void of embossments 18, however, it may contain deformations that form a "micro" pattern.

A visually recognizable softness region 14 may be void of signature elements.

The embossments 18 may be combined to form a "stitch" appearance within a visually recognizable strength region 16.

A visually recognizable softness region 14 may appear to be a pillow that is dispersed throughout a stitched portions (visually recognizable strength regions 16 for example).

A fibrous structure surface area ratio of visually recognizable softness regions 14 to visually recognizable strength regions 16 may be at least about 1:2 and/or at least about 1:3 and/or at least about 1:4 and/or at least about 1:5. For example, the fibrous structure surface are ratio of visually recognizable softness regions 14 to visually recognizable strength regions 16 may be from about 1:10 to about 1:2 and/or from about 1:8 to about 1:2.5 and/or from about 1:6 to about 1:3 and/or from about 1:5 to about 1:3.

Figure 2:
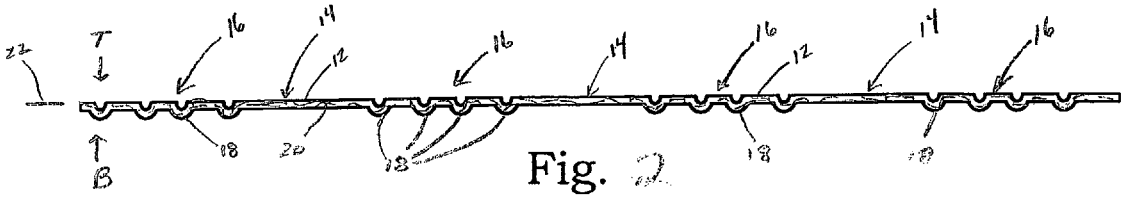
FIG. 2 is an enlarged cross sectional view of the fibrous structure shown in FIG. 1 taken along line 2-2.

A representative cross section of the fibrous structure 10 taken along line 2-2 is represented in FIG. 2. FIG. 2 shows the fibrous structure 10 and a plurality of embossments 18. The fibrous structure 10 comprises at least one fiber 20. A plurality of fibers 20 are shown in the embodiment of the fibrous structure 10. As shown in FIGS. 1 and 2, the embossments 18 may be domes.

As shown in FIG. 2, the embossments 18 appear to extend from (protrude from) a plane 22 of the fibrous structure 10 toward an imaginary observer looking in the direction of arrow B. When viewed by an imaginary observer looking in the direction indicated by arrow T, the embossments 18 appear to be cavities or dimples or depressions. The portions of the fibrous structure 10 forming the embossments 18 can be intact; however, the portions of the fibrous structure 10 forming the embossments 18 can comprise one or more holes or openings extending essentially through the fibrous structure 10.

In the fibrous structures of the present invention, at least one of the embossments may at least retain at least one of its dry properties such as its structural shape, height and the like after being wetted, such as after being saturated with water. For example, the embossments may retain at least 10% and/or 20% and/or 30% and/or 40% and/or 50% and/or 60% of its dry structural height as measured according to the Dry-Wet Structural Height Test Method described herein. In one embodiment, the embossment retains at least about 100% (even adding structural height to be greater than the dry height of the embossment) of its dry structural height as measured according to the Dry-Wet Structural Height Test Method described herein.

Fibrous Structure Additives

The fibrous structures of the present invention may comprise, in addition to fibers, an optional additive selected from the group consisting of permanent and/or temporary wet strength resins, dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers, softening agents, lotions and mixtures thereof. Such optional additives may be added to the fiber furnish, the embryonic fibrous web and/or the fibrous structure.

Such optional additives may be present in the fibrous structures at any level based on the dry weight of the fibrous structure.

The optional additives may be present in the fibrous structures at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

Processes for Making Fibrous Structures

The fibrous structures of the present invention may be made by any suitable process known in the art.

In one example of a process for making a fibrous structure of the present invention, the process comprises the step of forming a fibrous structure that comprises a visually recognizable softness region and a visually recognizable strength region.

In another example of a process for making a fibrous structure of the present invention, the process comprises the step of embossing a fibrous structure such that the fibrous structure comprises a visually recognizable softness region and a visually recognizable strength region.

The fibrous structures of the present invention may be made by a process wherein a fibrous furnish is applied to a first foraminous member to produce an embryonic fibrous web. The embryonic fibrous web may then come into contact with a second foraminous member that comprises a deflection member to produce a visually recognizable softness region and a visually recognizable strength region within an intermediate fibrous web. The intermediate fibrous web may then be further dried to form a fibrous structure of the present invention.

The fibrous structure may be subjected to any other suitable post processing steps such as calendering and/or embossing and/or converting.

Test Method

Dry-Wet Structural Height Test Method

The GFM Primos Optical Profiler system measures the surface height of a sample using the digital micro-mirror pattern projection technique. The result of the analysis is a map of surface height (z) vs. xy displacement. The system has a field of view of 27×22 mm with an xy resolution of 21 microns. The height resolution should be set to between 0.10 and 1.00 micron. The height range is 64,000 times the resolution.

Dry samples require no preparation prior to measurement.

To prepare a wet sample, a 11.33 cm (4.5 inch) wide by 20.32 cm (8 inch) long strip of a fibrous structure or sanitary tissue product to be tested is prepared. First, the sample is measured dry as described below. Holding one end of the sample vertically by the corners, a 10.16 cm (4 inch) long portion of the sample (½ of the length of the sample) at the distal end from where the sample is being held by the corners is dipped slowly and carefully into a pool of water. After the dipped portion of the sample is fully saturated, the saturated portion of the sample is removed from the water and dewatered by carefully laying the saturated portion of the sample on a dry sheet of Bounty® paper towel avoiding any folds or wrinkles in the tissue. After 20 seconds the portion of the sample being dewatered is carefully removed from the sheet of paper towel and placed on a second dry sheet of Bounty® paper towel for 20 seconds. A third dry sheet of Bounty® paper towel is similarly used for an additional 20 seconds. Still while handling the portion of the sample that was not saturated, the portion of the sample that was saturated is carefully laid over a stainless steel square of size 130×130×2 mm with a cut out of 90×90 mm in the center. If necessary, the sample can be very slightly tensioned so that when the stainless steel square is lying on a flat surface the fibrous structure or sanitary tissue product does not sag and/or touch the flat surface. Slightly touching the portion of the sample that was saturated where it contacts the steel square serves to tack the portion of the sample to the square and prevents further movement. The sheet is allowed to air dry for an additional 2 minutes prior to measurement as described below.

To measure a fibrous structure sample or sanitary tissue product sample do the following:

1. Turn on the cold light source. The settings on the cold light source should be 4 and C, which should give a reading of 3000K on the display;
2. Turn on the computer, monitor and printer and open the ODSCAD 4.14 Software.
3. Select "Start Measurement" icon from the Primos taskbar and then click the "Live Pic" button.
4. Place the sample under the projection head, center the features of interest within the field of view of the live image, and adjust the distance for best focus.
5. Click the "Pattern" button repeatedly to project one of several focusing patterns to aid in achieving the best focus (the software cross hair should align with the projected cross hair when optimal focus is achieved). Position the projection head to be normal to the sample surface.
6. For dry samples, with a permanent marker, place small dots on the sample at the corners of the illumination square. For the wet samples, use the four previous marks to realign the features of interest with the field of view.
7. Adjust image brightness by changing the aperture on the lens through the hole in the side of the projector head and/or altering the camera "gain" setting on the screen. Do not set the gain higher than 7 to control the amount of electronic noise. When the illumination is optimum, the red circle at bottom of the screen labeled "I.O." will turn green.
8. Select Standard measurement type.
9. Click on the "Measure" button. This will freeze on the live image on the screen and, simultaneously, the image will be captured and digitized. It is important to keep the sample still during this time to avoid blurring of the captured images. The images will be captured in approximately 20 seconds.

10. If the height image is satisfactory, save the image to a computer file with ".omc" extension. This will also save the camera image file ".kam".
11. To move the data into the analysis portion of the software, click on the clipboard/man icon.
12. Now, click on the icon "Draw lines" or "Draw freehand line" as needed. For samples where the raised structures lie in a straight line, select the starting and ending line points with the mouse so that the marked line traverses several features. If the raised structures are not on a straight line, use the freehand line tool to mark points in the centers of the structures such that the structures will be connected with a curved line. Once the line is created, select "Show sectional line diagram" to create a plot of the height versus distance along the line. Use the "Vertical distance" tool to mark a point in the baseline region between structures, and a point at the top of the structure and record the height calculated. Repeat the measurement for each structure along the line. The average height of the features is reported in micron units.

All documents cited in the Detailed Description of the Invention are, in relevant part, incorporated herein by reference; the citation of any document is not to be considered as an admission that it is prior art with respect to the present invention. Terms or phrases defined herein are controlling even if such terms or phrases are defined differently in the incorporated herein by reference documents.

While particular examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a plurality of individually discrete softness regions wherein an individually discrete softness region comprises an area encircled by a plurality of embossments, wherein the area encircled by the plurality of embossments is void of embossments and strength regions comprising a plurality of dome embossments different from the plurality of embossments encircling the area forming the discrete softness regions, wherein the softness regions are dispersed throughout the strength regions and wherein the fibrous structure surface area ratio of softness regions to strength regions is from about 1:10 to about 1:2.

2. The fibrous structure according to claim 1 wherein at least one of the embossments exhibits a dry structural height of at least 100 μm.

3. A single- or multi-ply sanitary tissue product comprising a fibrous structure according to claim 1.

4. An embossed fibrous structure comprising a plurality of individually discrete softness regions wherein an individually discrete softness region comprises an area encircled by a plurality of embossments, wherein the area encircled by the plurality of embossments is void of embossments and strength regions comprising a plurality of dome embossments different from the plurality of embossments encircling the area forming the discrete softness regions, the discrete softness regions being dispersed throughout the strength regions, and the softness regions comprise less embossments than the strength regions wherein the embossed fibrous structure surface area ratio of softness regions to strength regions is from about 1:10 to about 1:2.

5. A single- or multi-ply sanitary tissue product comprising an embossed fibrous structure according to claim 4.

6. An embossed fibrous structure comprising a plurality of individually discrete softness regions wherein an individually discrete softness region comprises an area encircled by a plurality of embossments, wherein the area encircled by the plurality of embossments is void of embossments and strength regions comprising a plurality of dome embossments different from the plurality of embossments encircling the area forming the discrete softness regions, wherein the embossed fibrous structure essentially consists of a plurality of dome embossments, wherein the plurality of dome embossments exhibit a substantially similar shape wherein the embossed fibrous structure surface area ratio of softness regions to strength regions is from about 1:10 to about 1:2.

7. A single- or multi-ply sanitary tissue product comprising an embossed fibrous structure according to claim 6.

* * * * *